US006546773B2

(12) United States Patent
Hanafusa et al.

(10) Patent No.: US 6,546,773 B2
(45) Date of Patent: Apr. 15, 2003

(54) CAN MANUFACTURING APPARATUS, CAN MANUFACTURING METHOD, AND CAN

(75) Inventors: Tatsuya Hanafusa; Masahiro Hosoi; Aki Ikeda, all of Shizuoka-Ken (JP)

(73) Assignee: Mitsubishi Materials Corporation, Shizuoka-ken (JP)

( * ) Notice: Subject to any disclaimer, the term of this patent is extended or adjusted under 35 U.S.C. 154(b) by 0 days.

(21) Appl. No.: 09/895,253

(22) Filed: Jul. 2, 2001

(65) Prior Publication Data

US 2001/0045116 A1 Nov. 29, 2001

Related U.S. Application Data

(62) Division of application No. 09/589,512, filed on Jun. 8, 2000, now Pat. No. 6,296,139.

(30) Foreign Application Priority Data

Nov. 22, 1999 (JP) ..... 11-332045

(51) Int. Cl.[7] ..... B21D 51/26
(52) U.S. Cl. ..... 72/111; 72/379.4
(58) Field of Search ..... 72/94, 110, 117, 72/353.4, 353.6, 379.4, 393, 111

(56) References Cited

U.S. PATENT DOCUMENTS 4,885,924 A * 12/1989 Claydon et al. ..... 72/111
5,069,052 A * 12/1991 Porcuznik et al. ..... 72/84
5,222,385 A * 6/1993 Halasz et al. ..... 72/393
5,355,709 A * 10/1994 Bauder et al. ..... 72/393
5,934,127 A * 8/1999 Ihly ..... 72/379.4

* cited by examiner

*Primary Examiner*—Lowell A. Larson
(74) *Attorney, Agent, or Firm*—Oblon, Spivak, McClelland, Maier & Neustadt, P.C.

(57) ABSTRACT

A manufacturing apparatus for manufacturing a can having a can body including a dome section and an annular projection. The dome section is formed on a bottom of the can and is recessed inwardly of the can body. The annular projection is formed around a peripheral edge of the dome section so as to project outwardly in a direction of an axis of the can. A plurality of inner recesses are formed on an inner wall of the annular projection. The apparatus includes: an apparatus main body; a mandrel disposed on the apparatus main body for supporting the can body; a can bottom processing unit disposed on the apparatus main body so as to be relatively movable in the direction of the can axis with respect to the can bottom. The can bottom processing unit includes: a plurality of punch pawls having extreme ends which are disposed in a circumferential direction, which are movable in a radial direction, and which project toward the mandrel; a punch pawl expanding member which moves the extreme ends outwardly in the radial direction; and a dome support member which abuts the dome section from the inside of the punch pawls in the radial direction and supports the dome section. The apparatus produces a can having a reduced can bottom thickness, but still has a sufficient can strength without deformation of the can bottom and in which the phenomenon of bottom growth is suppressed.

4 Claims, 12 Drawing Sheets

| ANGLE | PRESSURE WITHSTANDING STRENGTH | FALLING STRENGTH | RESULT |
|---|---|---|---|
| 80 | 946 | 15 | X |
| 85 | 945 | 20 | 0 |
| 90 | 943 | 20 | 0 |
| 98 | 945 | 25 | 0 |
| 101 | 944 | 30 | 0 |
| 103 | 935 | 30 | 0 |
| 105 | 791 | 30 | X |
| A CAN BOTTOM BEFORE PROCESSING | 670 | 25 | |

*FIG. 15*

CAN MANUFACTURING APPARATUS, CAN MANUFACTURING METHOD, AND CAN

This application is a Division of application Ser. No. 09/589,512 Filed on Jun. 8, 2000, now U.S. Pat. No. 6,296,139.

CROSS-REFERENCE TO RELATED APPLICATIONS

This application is related to and claims priority under 35 U.S.C. § 119 to Japanese Patent Application No. HEI 11-332045, filed on Nov. 22, 1999, entitled "CAN MANUFACTURING APPARATUS, CAN MANUFACTURING METHOD, AND CAN," and incorporated by reference herein.

BACKGROUND OF THE INVENTION

1. Field of the Invention

The present invention relates to a can manufacturing apparatus, a can manufacturing method, and a can, wherein the apparatus for manufacturing the can has a dome section and an annular projection, the dome section being formed on a bottom of the can and is recessed inwardly of a body of the can, and the annular projection being formed around the peripheral edge of the dome section so as to project outwardly in a can axis direction.

2. Discussion of Background

Two-piece aluminum alloy cans composed of a cylindrical bottomed can body is well known. A can end is fixed to an opening in the can body. The can body of the two-piece can is made by, first, stamping and drawing an aluminum alloy blank sheet to form a cup member using a drawing apparatus. Then, the cup member is redrawn and ironed with a punch sleeve inserted therein, while the cup member is held. In this way, the peripheral edge of the bottom portion of the cup member is drawn, while it is clamped between the punch sleeve and a dome molding unit. The dome molding unit has a semi-spherical extreme end and is disposed in opposition to the punch sleeve so as to be coaxially therewith. Thus, a can body 101, having the bottom shape shown in FIG. 13, is obtained.

The can bottom 103 of the can body 101 has a dome section 105 and an annular projection (rim) 107 formed thereon. The dome section 105 is spherically recessed inwardly of the can body 101, and the annular projection (rim) 107 joins the peripheral edge of the dome section 105 and projects outwardly of the can body 101 in a direction of the can axis. The annular projection 107 acts as a leg, which is in contact with the ground, when the can body 101 stands upright. Thus, the standing stability and supporting strength of the can body 101 can be improved.

Today's trend toward reduced wall thickness of cans to save resources and costs has lead to various disadvantages due to the reduction of the strength of the cans. One disadvantages results from a phenomenon called bottom growth, wherein an annular projection 107 of a can bottom 103 is deformed outwardly in a radial direction, while projecting downwardly due to the action of internal pressure, after contents are packed into the can (see the double dot and dashed line of FIG. 14). One of factors which causes bottom growth is the insufficient rigidity of an inner wall 107*a,* acting as the inner peripheral wall of the annular projection 107. A first peripheral edge of the inner wall 107*a* is joined to the dome section 105 through a counter sink R-section 109 to form a concave surface. A second peripheral edge of the inner wall 107*a* is joined to a nose section 107*b* to form an extreme end of the annular projection 107. When an internal pressure acts on the can bottom 103, the thin inner wall 107*a* is stressed in the circumferential direction and in the direction of the can axis. In particular, when the stress (elongation) in the direction of the can axis is increased, the annular projection 107 is deformed downwardly and radially outwardly.

When bottom growth occurs, the total height of a can is increased. Thus, problems may arise due to the can's increased height, such as the cans may become caught on a conveyor as the can is transported to be packaged or the cans may be difficult to package.

Another problem is that as the thickness of the can is reduced, the falling strength of a can bottom becomes insufficient. In other words, when a can falls, the peripheral portion of the dome section 55 of the can bottom 53, which is a particularly fragile portion when subjected to shock caused by a can's fall, swells and may be broken in the worst-case scenario.

In view of the above-described disadvantages, an object of the present invention is to provide a can, a can manufacturing apparatus and a can manufacturing method, wherein the apparatus and method are for manufacturing a can having a reduced wall thickness, particularly in the can bottom, yet retaining sufficient can strength so as to prevent deformation of the can bottom and suppress bottom growth.

SUMMARY OF THE INVENTION

According to a first aspect of the present invention, the can manufacturing apparatus is for forming a can body having a dome section and an annular projection, wherein the dome section is formed on the can bottom and is recessed inwardly, and wherein the annular projection is formed around the peripheral edge of the dome section and projects outwardly in the direction of the can axis. The annular projection has an inner peripheral wall with a plurality of inner recesses in a circumferential direction. The plurality of recesses are recessed inwardly. The can manufacturing apparatus includes: an apparatus main body; a can body support means, disposed on the apparatus main body for supporting the can body; and a can bottom processing means, disposed on the apparatus main body. The can bottom processing means moves relatively in the direction of the can axis with respect to the can bottom. The can processing means includes: a plurality of punch pawls disposed in the circumferential direction, wherein each punch pawl has an extreme end section, movable in a radial direction and projecting toward the can body support means; a punch pawl moving means for moving the extreme ends outwardly in the radial direction; and a dome support means, which abuts the dome section from the inside of the punch pawls, in the radial direction thereof, for supporting the dome section.

In the can manufacturing apparatus, the can bottom processing means expands the extreme ends of the punch pawls by moving relatively, with respect to the can bottom, in the direction of the can axis. In this way, the inner recesses are formed on the inner peripheral wall of the annual projection of the can bottom. Since the inner recesses can be formed while pressing the dome section with the dome support member, the dome section hangs down when the inner recesses are formed.

It is preferable that the can manufacturing apparatus, according to the first aspect of the present invention, is arranged such that the can and the can body support means are movable in the direction of the can axis, with respect to the apparatus main body. The can bottom forming means is unmovable in the direction of the can axis, with respect to the apparatus main body.

The can manufacturing apparatus has a relatively simple arrangement as a whole, even though the can bottom processing means has a relatively complex arrangement and is unmovable with respect to the apparatus main body and the can body support means. This is in part because the can body support means has a relatively simple arrangement and is movable with respect to the apparatus main body.

Preferably, the can manufacturing apparatus, according to the first aspect of the present invention, includes: an outer peripheral wall forming means for forming the outer peripheral wall of the annular projection.

In the can manufacturing apparatus, the inner and outer peripheral walls of the annular projection can be substantially simultaneously formed during the same step.

According to a second aspect of the present invention. A can manufacturing method for manufacturing a can having a dome section and an annular projection. The dome section is formed on the bottom of the can and is recessed inwardly of the body of the can. The annular projection is formed around the peripheral edge of the dome section and projects outwardly in the direction of the can axis. A plurality of inner recesses are formed on the inner peripheral wall of the annular projection in a circumferential direction so as to be recessed inwardly of the can body. The can manufacturing method includes the steps of: supporting the can body; supporting the dome section with a dome support member which abuts the dome section; and forming a plurality of inner recesses, wherein each inner recess is recessed inwardly of the can body on the inner peripheral wall of the annular projection in the circumferential direction. The recessing of the inner recess is accomplished by moving the extreme ends of a plurality of punch pawls. The punch pawls are disposed in the circumferential direction and are movable in a radial direction from a region located inwardly of the nose section of the annular projection at the extreme end thereof in the radial direction to an external region in the radial direction.

According to the can manufacturing method, the inner recesses can be correctly formed in the region inwardly of the nose section of the annular projection in the radial direction by moving the punch pawls outwardly in the radial direction. The punch pawls abut the can bottom, after the annular projection is formed. The recesses are formed independently of the formation of the annular projection. Accordingly, stress in a planar direction and stress in a thickness direction do not simultaneously act on the inner peripheral wall. This results in a prevention of the occurrence of cracks in the inner recesses. Cracks would otherwise occur due to the severe plastic deformation likely to be caused when the inner recesses are formed simultaneously with the annular projection.

According to a third aspect of the present invention, a can is formed having a dome section and an annular projection. The dome section is formed on a bottom of the can and is recessed inwardly of a body of the can. The annular projection is formed around the peripheral edge of the dome section so as to project outwardly in the direction of the can axis. A plurality of inner recesses are formed on the inner peripheral wall of the annular projection in a circumferential direction so as to be recessed inwardly of the can body, wherein each of the inner recesses is curved at a predetermined radius of curvature. An angle θ, located between the tangential line at the upper end of each inner recess and the tangential line at the lower end thereof, is set to satisfy the inequality, $83° \leqq \theta \leqq 103°$, and more preferably to satisfy the inequality, $98° \leqq \theta \leqq 103°$.

In the can arranged as described above, a sufficient can strength can be secured by improving the pressure withstanding strength and the falling strength of the can.

In the can according to the third aspect of the present invention, when the shortest radius of the inner peripheral wall is represented by D1 and the longest radius of the dome section is represented by D3, it is preferable that the radii have the relationship of $1.01 \leqq D3/D1 \leqq 1.15$.

In the can arranged as described above, since the inner recesses are formed so that the relationship of $1.01 \leqq D3/D1 \leqq 1.15$ is satisfied, the strength of the can can be more increased.

In the can according to the third aspect of the present invention, it is preferable that the region, where the inner recesses of the inner peripheral wall are formed when viewed in the cross section in the circumferential direction, is 63 to 99% of the entire inner peripheral wall in the circumferential direction.

In the can arranged as described above, the inner peripheral wall portion of the annular projection can obtain a sufficient rigidity by setting the range where the inner recesses is formed to be the above-described region.

Incidentally, the inner recesses can be stably formed, the occurrence of bottom growth can be prevented, and the pressure withstanding strength of the can are improved by forming the inner recesses at locations nearer to the dome section than the portion of the inner peripheral wall. The portion of the inner peripheral wall projects inwardly in the radial direction. The shortest diameter of the inner peripheral wall is formed by forming the inside recesses inwardly of the can body at an angle of 20°–50° with respect to a tangential line extended from the projecting portion in the can axis direction.

According to the third aspect of the present invention, it is preferable that the can have molded sections, which are recessed inwardly of the can body. The molded sections are formed at a portion between the center of the dome section and the inner peripheral wall and number as many as the inner recesses. The molded sections are formed annularly about the center of the dome section.

The can thus formed has an increase can bottom strength and reduced bottom growth.

Incidentally, the strength of the dome section can be increased and stably processed by forming the molded sections to satisfy $0.65 \leqq D2/D1 \leqq 0.9$, where D1 represents the shortest diameter of the inner peripheral wall and D2 represents the annular diameter of the annularly disposed molded sections.

BRIEF DESCRIPTION OF THE DRAWINGS

FIG. 15 is a table, which in association with FIG. 12, explains why each inner recess is formed to have an angle θ between the tangential line at the inflection point P2 and the tangential line at the inflection point P2 be within the range of 85° and 103° and more preferably, within the range of 90° and 103°.

DESCRIPTION OF THE PREFERRED EMBODIMENTS

Embodiments of the present invention will be described below using the drawings.

First, a can manufacturing apparatus will be described using FIGS. 1 to 5.

Figure 1:
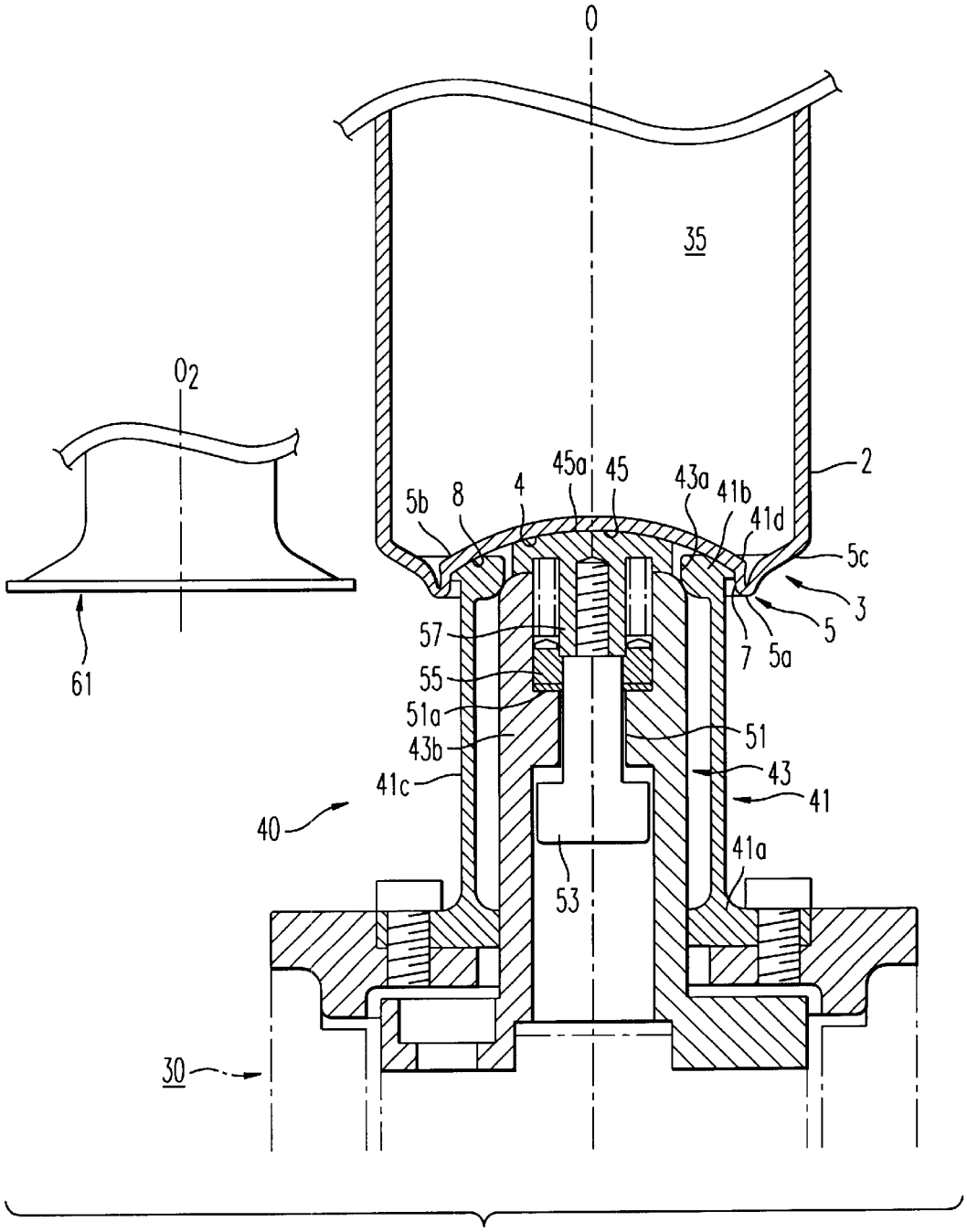
FIG. 1 is a schematic view showing an embodiment of a can manufacturing apparatus according to the present invention and explains how a can is manufactured.

As shown in FIG. 1, the manufacturing apparatus includes an apparatus main body 30. A mandrel (can body support means) 35, for supporting a can body 2, is disposed adjacent to the apparatus main body 30. A can bottom processing means 40 is disposed adjacent to the apparatus main body 30 so as to be relatively movable in a direction of the can axis 0 with respect to a can bottom 3. A molding roller (outer peripheral wall molding means) 61 is disposed adjacent to the apparatus main body 30 and is rotatable around a rotational axis $\mathbf{0}_2$.

The can body 2, shown in FIG. 1, is manufactured by being sequentially subjected to: a drawing step for molding a cylindrical bottomed cup from a blank sheet; a redrawing and ironing step; and a can bottom molding step, for redrawing and ironing the cup by inserting a punch sleeve into the cup, as well as molding a dome section 4 and an annular projection 5 by clamping a can bottom 3 between the punch sleeve and a dome molding unit, a print step for printing the outer surface of the can body 2, and a necking step for forming the upper end portion (neck) of the opening of the can body 2. In the first embodiment, the can manufacturing apparatus is shown in a process during the necking step. The mandrel 35 is a cylindrical member which is moved by an actuator (not shown) in the direction of the can axis 0 with respect to the apparatus main body 30. The mandrel 35 has a shape and size such that it is substantially in intimate contact with the inner surface of the can body 2 when inserted thereinto. The mandrel 35 includes a suction means (not shown) for sucking the air in the can body 2 so that the can body 2 is adhered to the mandrel 35 and supported thereby. In other words, the can body 2 is relatively unmovable with respect to the mandrel 35, but the can body 2 is movable in the direction of the can axis 0 together with the mandrel 35.

The can bottom processing means 40 includes: punch pawls 41 having extreme ends 41*b* which are movable in a radial direction and project from the punch pawls 41 toward the mandrel 35; a punch pawl expanding member (punch pawl moving means) 43 which moves relative to the direction of the can axis 0 with respect to the punch pawls 41 to thereby move the extreme ends 41*b* outwardly in the radial direction; and a dome support member 45 which is mounted on the punch pawl expanding member 43 and which abuts the dome section 4 to thereby support it. The can bottom processing means 40 is rotated about the can axis 0 by a rotation means (not shown).

The punch pawls 41 are formed by dividing the extreme end of a cylindrical member, composed of spring steel, die steel, or similar, into a plurality of pieces. The ring-shaped base end 41*a* of the punch pawls is mounted on the apparatus main body 30 so as to be relatively unmovable in the direction of the can axis 0 with respect to the apparatus main body 30.

Figure 3:
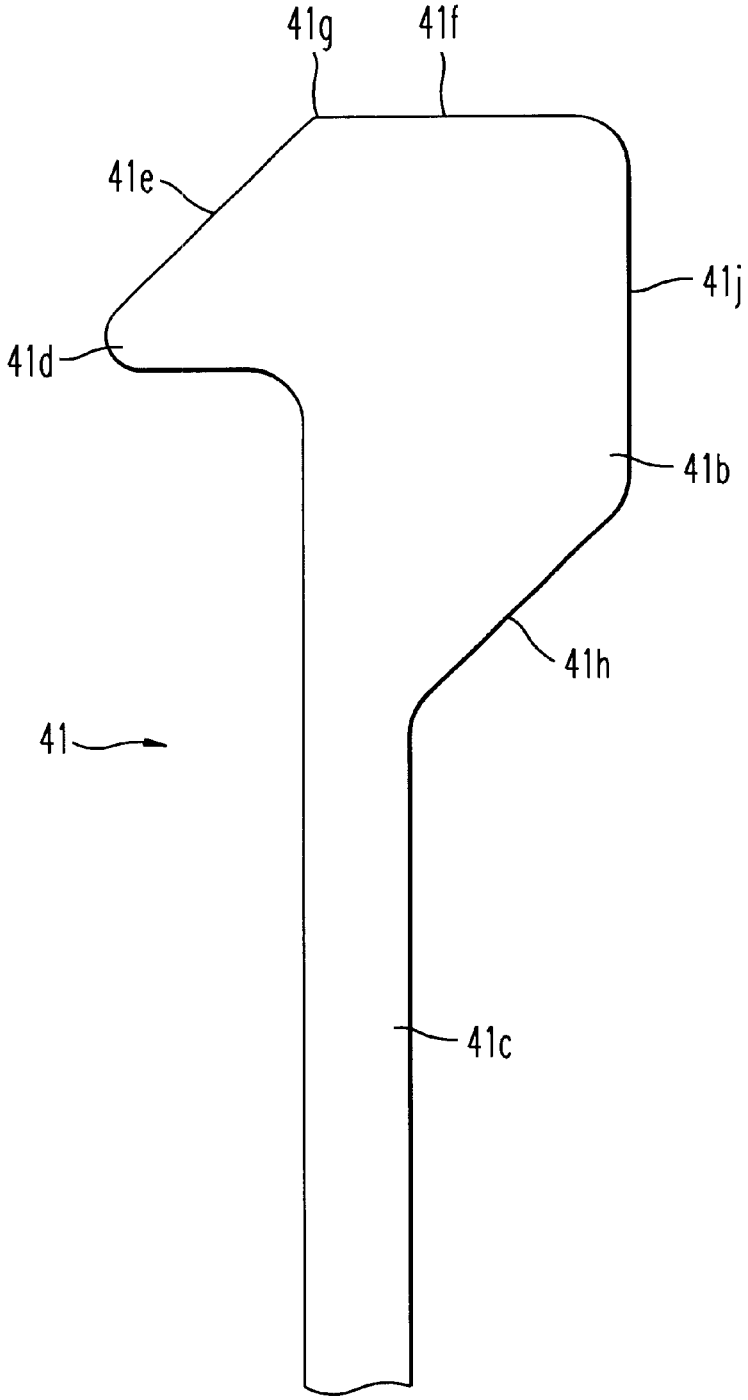
FIG. 3 is a view explaining a punch pawl.

As shown in FIGS. 1 and 3, since the width in a radial direction of the extreme end 41*b* of each punch pawl 41 is made larger than that of the intermediate section 41*c* thereof, the extreme end 41*b* can be moved in the radial direction by being elastically deformed together with respect to the intermediate section 41*c*. The extreme end 41*b* of the punch pawl 41 has a pawl 41*d* formed thereon, the pawl 41*d* projecting outwardly in the radial direction. An inclining surface 41*e*, which inclines toward the extreme end of the pawl 41*d* in a planar shape as it extends inwardly in the radial direction, is formed on the pawl 41*d*. Further, an extreme end corner 41*g* projects from the extreme end of the inclining surface 41*e* toward the dome section 4 of the can body 2. Furthermore, an extreme end surface 41*f* and an inner surface 41*j* are formed in a planar shape, and the portion of the inner surface 41*j* located on the base end 41*a* side has an inner inclining surface 41*h* formed thereon. The inner inclining surface 41*h* has a curved surface shape so that it is directed inwardly in the radial direction as it extends to its extreme end so as to connect the intermediate section 41*c* to the inner surface 41*j*.

Figure 4:
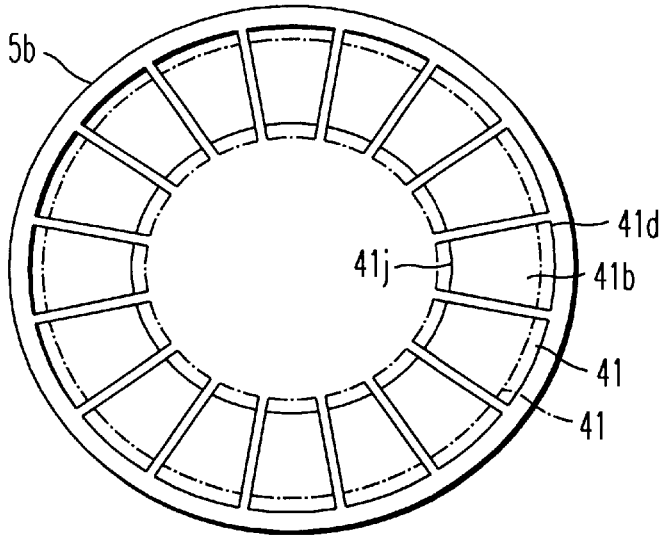
FIG. 4 is a view explaining how punch pawls are expanded and contacted.

As shown in FIG. 4, a plurality (sixteen) of the punch pawls 41 are annularly disposed separately from each other. The contour shape of the cross section of the pawl 41*d*, formed on the outside of the extreme end 41*b* of each punch pawl 41, is formed in an arc shape, and the surfaces of adjacent punch pawls 41 are formed in a planar shape. The punch pawls 41 are elastically deformed in the radial direction between the original locations thereof and the locations shown by numeral 41, as illustrated by broken lines.

Incidentally, the punch pawls 41 can be easily made by forming slits only at the extreme end of a steel cylinder arranged as a single piece. Since the punch pawls 41 are moved in the radial direction by the elastic deformation thereof, structurally simple, and easily maintainable, the punch pawls 41 can be reliably actuated and stably used for a long period of time.

Further, the inner surface of the extreme end 41*b* of each punch pawl 41 (i.e., the inner inclining surface 41*h* or the inner surface 41*j*) is abutted against an outer peripheral inclining surface 43*a* formed at the tapering extreme end of the cylindrical punch pawl expanding member 43.

The punch pawl expanding member 43 and the dome support member 45, mounted on the punch pawl expanding member 43, are moved by an actuator (not shown) relative to the direction of the can axis 0 with respect to the punch pawls 41. A small diameter hole 43*b* is formed in the punch pawl expanding member 43, as shown in FIG. 1, and a ring-shaped bushing 51 is mounted in the small diameter hole 43*b*. A bolt 53 is slidably inserted into the bushing 51, and the dome support member 45 is fitted over the bolt 53. The dome support member 45 has a T-shaped cross section, and the extreme end surface 45*a* of the dome support member 45 is formed to have a convex surface. The bushing 51, mounted in the small diameter hole 43*b* of the punch pawl expanding member 43, has a flange 51*a* formed at the extreme end thereof, and the flange 51*a* is locked in the small diameter hole section 43*b* to thereby regulate the movement of the bushing 51 to the base end (lower side in FIGS. 1 and 2). A ring 55 and a spring 57 are mounted in a space formed by the punch pawl expanding member 43, the dome support member 45, the bushing 51, and the bolt 53, and the dome support member 45 and the bolt 53 are urged to the extreme end (upper side in FIGS. 1 and 2) by the spring 57.

The molding roller 61 is mounted on the apparatus main body 30 so as to freely rotate about the rotational axis $\mathbf{0}_2$ and to approach, then separate from, the outside of the can bottom 3.

Next, a method of manufacturing a can 1 using the manufacturing apparatus arranged as described above will be described.

First, the can body 2 is supported by the mandrel 35 and positioned coaxially with the can bottom processing means 40.

Figure 2:
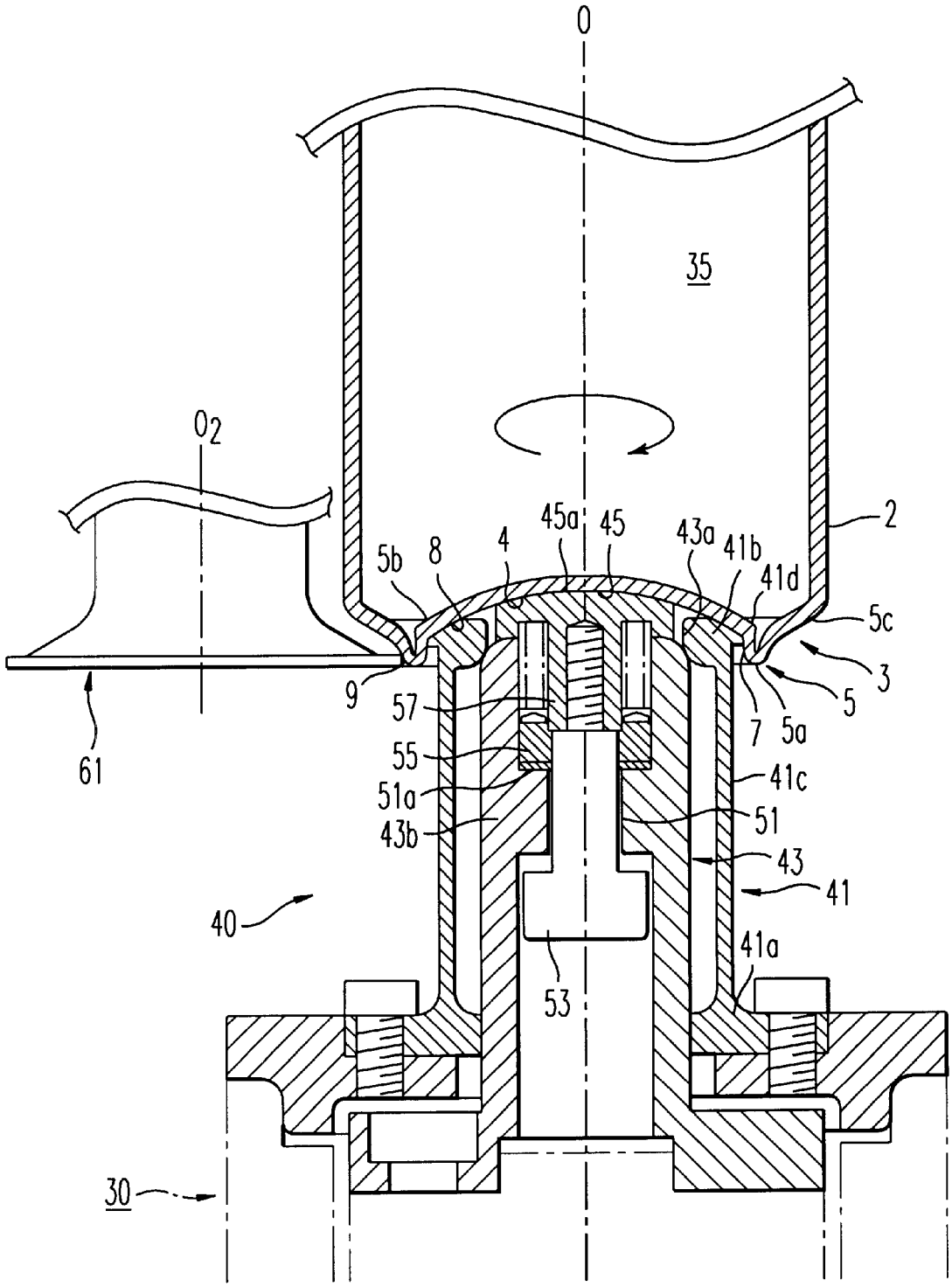
FIG. 2 is a schematic view explaining how the can is manufactured similarly to FIG. 1.

Next, the mandrel 35 is moved to the can bottom processing means 40 (lower side in FIGS. 1 and 2). In other words, the can bottom processing means 40 is moved relative to the can bottom 3 and stopped at a position where the extreme ends 41*b* of the punch pawls 41 abut a portion, which is inward of the nose 5*a* of the annular projection 5 (i.e., at a position where the extreme ends 41*b* of the punch pawls abut a portion from an inner wall (inner peripheral wall) to the dome section 4). At the time, since the dome support member 45 is urged forwardly of the extreme ends of the punch pawls 41 by the spring 57, the extreme end surface 45*a* abuts the dome section 4 of the can bottom 3 before the extreme ends 41*b* of the punch pawls 41 abut and are retracted from the base end by compression of the spring 57 due to the reaction force of abutment.

Therefore, the can body 2 is pressed against the mandrel 35 (upper side in FIGS. 1 and 2) by the dome support member 45, which is urged by the spring 57, and clamped between the mandrel 35 and the dome support member 45. Further, since the extreme end surface 45*a* of the dome support member 45 abuts the dome section 4, the deformation of the dome section 4 is regulated during the molding step. With this operation, the desired shape of the dome section 4 is obtained, whereby a pressure withstanding strength, which can sufficiently resist the internal pressure of the can 1 after contents are packed therein, can be secured.

Next, the punch pawl expanding member 43 is moved to the mandrel 35. With this operation, the outer peripheral inclining surface 43*a* of the punch pawl expanding member 43 is pressed against the inner peripheral inclining surfaces 41*h* of the punch pawls 41 and expands the extreme ends 41*b* the punch pawls 41. As a result, the pawls 41*d* of the punch pawls 41 press a region from the inner wall 5*b* of the annular projection 5 to the dome section 4 and form a plurality of inner recesses 7 in the region in the circumferential direction. Further, the extreme end corners 41*g* of the punch pawls 41 abut and press the peripheral portion of the dome section 4 to thereby form a plurality of molded sections 8 in an annular fashion. In other words, the inner recesses 7 and same number of molded sections 8 are formed on the can bottom 3.

Next, as shown in FIG. 2, the can body 2 is rotated about the can axis 0 by a rotation mechanism and the molding roller 61 is pressed against a portion, which is outward of the nose 5*a* of the annular projection 5 of the can bottom 3 (i.e., against the outer wall (outer peripheral wall) 5*c* of the annular projection 5) in the state in which the punch pawls 41 of the can bottom processing means 40 and the dome support member 45 are mounted on the can bottom 3. Then, an annular outer recess 9 is molded over the entire periphery of the outer wall 5*c* of the annular projection 5. Since the can bottom 3 is supported by the punch pawls 41 and the dome support member 45 when the outer recess 9 is formed, a desired shape of the outer recess 9 can be smoothly and correctly formed, without the deformation of the inner recesses 7 and the dome section 4 of the can bottom 3.

Further, the punch pawl expanding member 43 is retracted after the inner recesses 7 are formed to permit the extreme ends 41*b* of the punch pawls 41 to be moved inwardly in the radial direction by an elastic force. Next, the punch pawl expanding member 43 is retracted in a direction where it is separated from the can bottom 3. At the time, since the dome support member 45 is moved forwardly by the urging force of the spring 57 and continuously presses the can bottom 3, even if the punch pawls 41 are not smoothly separated from the can bottom 3, the punch pawls 41 can be reliably separated therefrom by the above-described movement. Next, the dome support member 45 returns to a waiting position to press a next can bottom 3. With the above steps, the molding of the inner recesses 7 on the can bottom 3 is finished.

The can body 2, to which the inner recesses 7 have been molded, is removed from the mandrel 35 and delivered to an area where the next step can be performed. During the next step, the can body 2 is completed by being necked and flushed. When contents are packed into the can body 2, formed as described above and a can end is attached thereto, the can 1 is completed (see FIG. 5).

According to the manufacturing apparatus and the manufacturing method of the present invention, the inner recesses 7 are molded in the region of the inner wall 5*b* of the annular projection 5 by moving the punch pawls 41 outwardly in the radial direction, while pressing the dome section 4 of the can bottom 3 with the dome support member 45. As a result, the inner recesses 7 are correctly formed and the dome section 4 is prevented from hanging down. when the inner recesses 7 are formed. Thus, the can bottom can be processed without unnecessarily deforming it.

Further, the punch pawls 41 abut the can bottom 3, after the annular projection 5 is molded thereto, and the inner recesses 7 are molded independently of the molding of the annular projection 5. Accordingly, stress in a planar direction and stress in a thickness direction do not simultaneously act on the inner wall 5*b*. As a result, the cracks in the inner recesses, which would normally occur due to severe plastic deformation likely to be caused when the inner recesses are formed simultaneously with the annular projection, can be prevented. Thus, the durability and reliability of the can 1 may be enhanced.

Further, since the can bottom processing means 40 has a relatively complex arrangement and is unmovable in the direction of the can axis 0 with respect to the apparatus main body 30, and the mandrel 35 having a relatively simple arrangement and movable in the direction of the can axis 0 with respect to the apparatus main body 30, the entire arrangement of the manufacturing apparatus can be simplified. Thus, the reliability of the manufacturing apparatus can be enhanced and the maintenance of the manufacturing apparatus can be easily carried out.

Further, since the outer wall 5*c* of the annular projection 5 is also molded substantially at the same time by the molding roller 61, the inner wall 5*b* and the outer wall 5*c* of the annular projection 5 can be molded at the same step. Since the can bottom 3 can be processed during the necking stop, the can bottom 3 may be processed without additionally installing a new manufacturing line. Thus, manufacturing steps can be simplified.

Note that while the movement of the can bottom processing means 40 is made impossible with respect to the apparatus main body 30 and the movement of the mandrel 35 is permitted with respect to the apparatus main body 30 in the manufacturing apparatus of the above embodiment, the movement of the mandrel 35 may be made impossible and the movement of the can bottom processing means 40 may be made possible, depending upon the circumstances of manufacturing steps. Further, the can support means may be arranged to regulate the movement of the can body 2 by, for example, abutting the upper end thereof, in addition to a means such as the mandrel 35 which is inserted into the can body 2. In short, any arrangement other than the above arrangement may be employed so long as it is a means for regulating the movement of a can body 2 when it is processed.

Next, a can 1 manufactured by the manufacturing method will be described using FIGS. 5 to 12.

Figure 5:
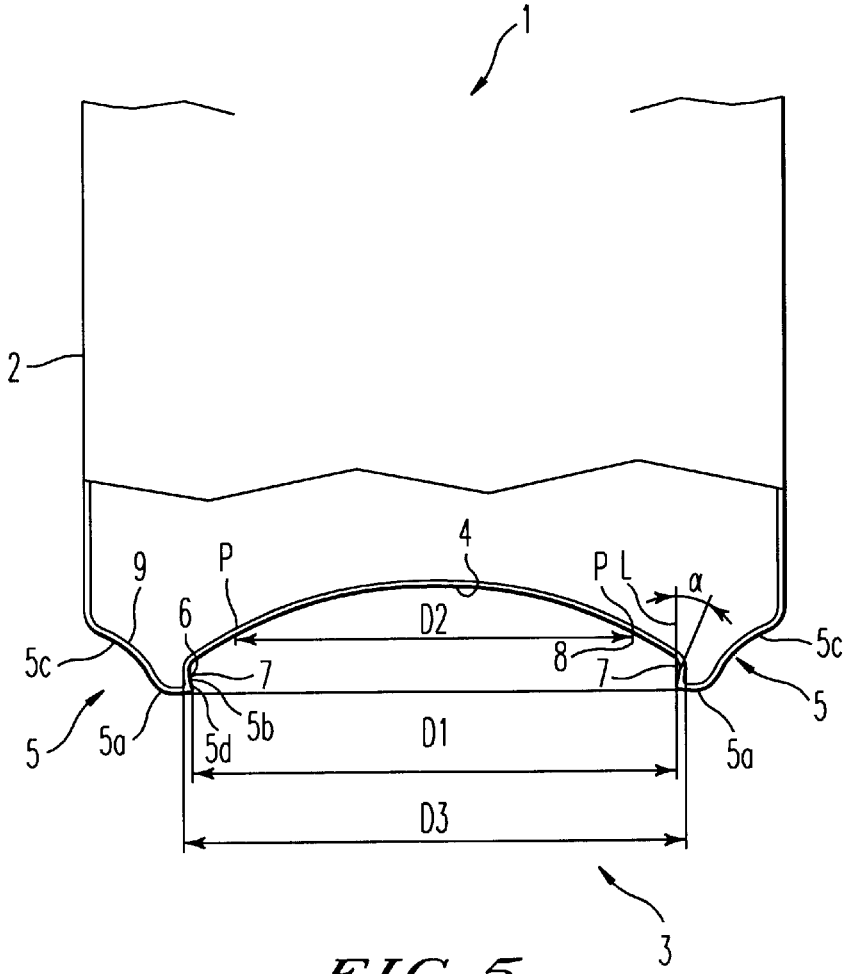
FIG. 5 is a side elevational view of a main portion of the can and shows the cross section of the bottom of the can.

In the can 1 shown in FIG. 5, the dome section 4, which is recessed inwardly of the can body 2, is formed on the can bottom 3 of the can body 2. Further, the annular projection (rim) 5 which projects outwardly of the can body 2 in the direction of the can axis 0 is formed around the peripheral edge of the dome section 4.

The annular projection 5 is composed of: the nose 5*a*, at the extreme end thereof; the inner peripheral wall (the inner wall) 5*b*, located internally of the nose 5*a* in the radial direction; and the outer peripheral wall (outer wall) 5*c*, located outwardly of the nose 5*a* in the radial direction. The inner wall 5*b* is joined to the dome section 4 through an annular concave surface (counter sink R-section) 6, whereas the nose 5*a* is joined to the can body 2 through the outer wall 5*c*. Further, an inner projection 5*d*, which projects inwardly in the radial direction, is formed under the inner wall 5*b*, and the shortest diameter (dome diameter) D1 of the dome section is formed at the inner projection 5*d*.

Figure 6:
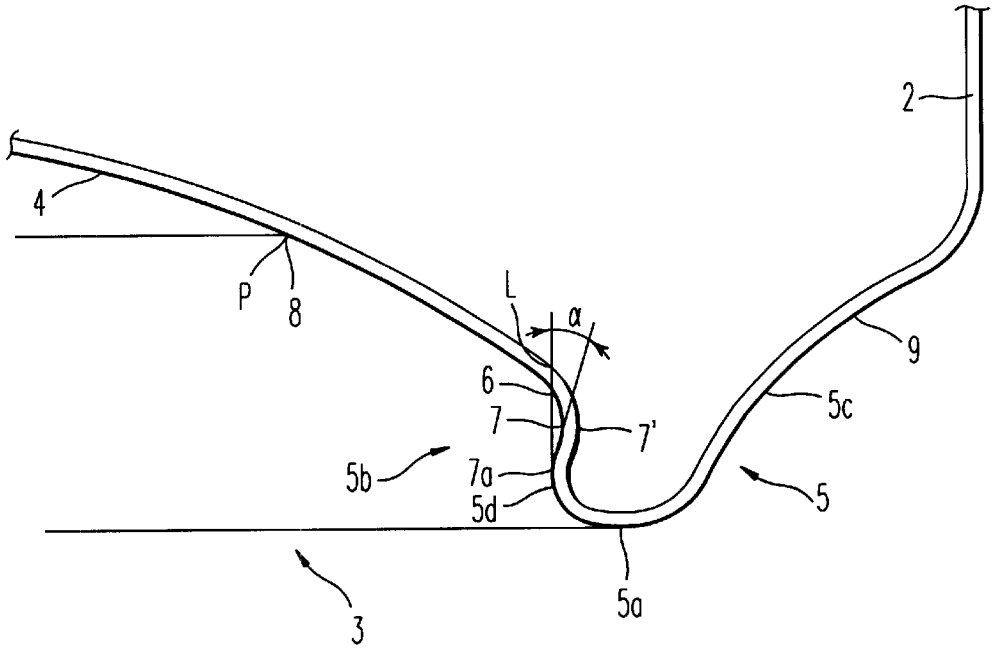
FIG. 6 is an enlarged view showing the vicinity of an annular projection in FIG. 5.

A plurality of the inner recesses, which are recessed inwardly of the can body 2, are formed on the inner projection 5*d* in the circumferential direction. Each of the inner recesses 7 has a cross section in the circumferential direction which is formed in an arc shape. As shown in FIG. 6, the inner recesses 7 are formed in the vicinity of the counter sink R-section 6 which is located nearer to the dome section than the inner projection 5*d*, and the lower sides 7*a* of the inner recesses 7 are disposed at the intermediate portion of the inner wall 5*b* so that they do not reach the extreme end of the nose 5*a*. Each inner recess 7 is formed outwardly of a broken line shown by numeral 7', which indicates a state in which the inner recesses 7 are formed, so as to be pushed inwardly of the can body 2 and has an angle $\alpha$ with respect to a line L, which is a tangential line extended from the inner projection 5*d* in the direction of the can axis 0. The inner recesses 7 are formed such that the angle $\alpha$ satisfies $20° \leqq \alpha \leqq 50°$.

Figure 7:
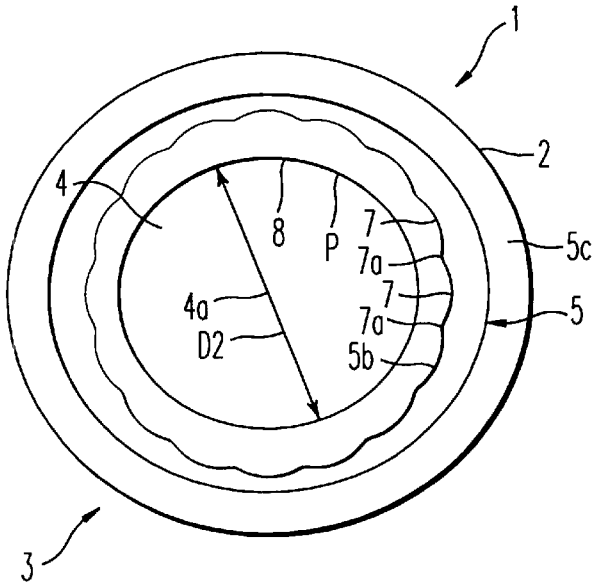
FIG. 7 is a view of the can when it is observed from the bottom thereof.
Figure 8:
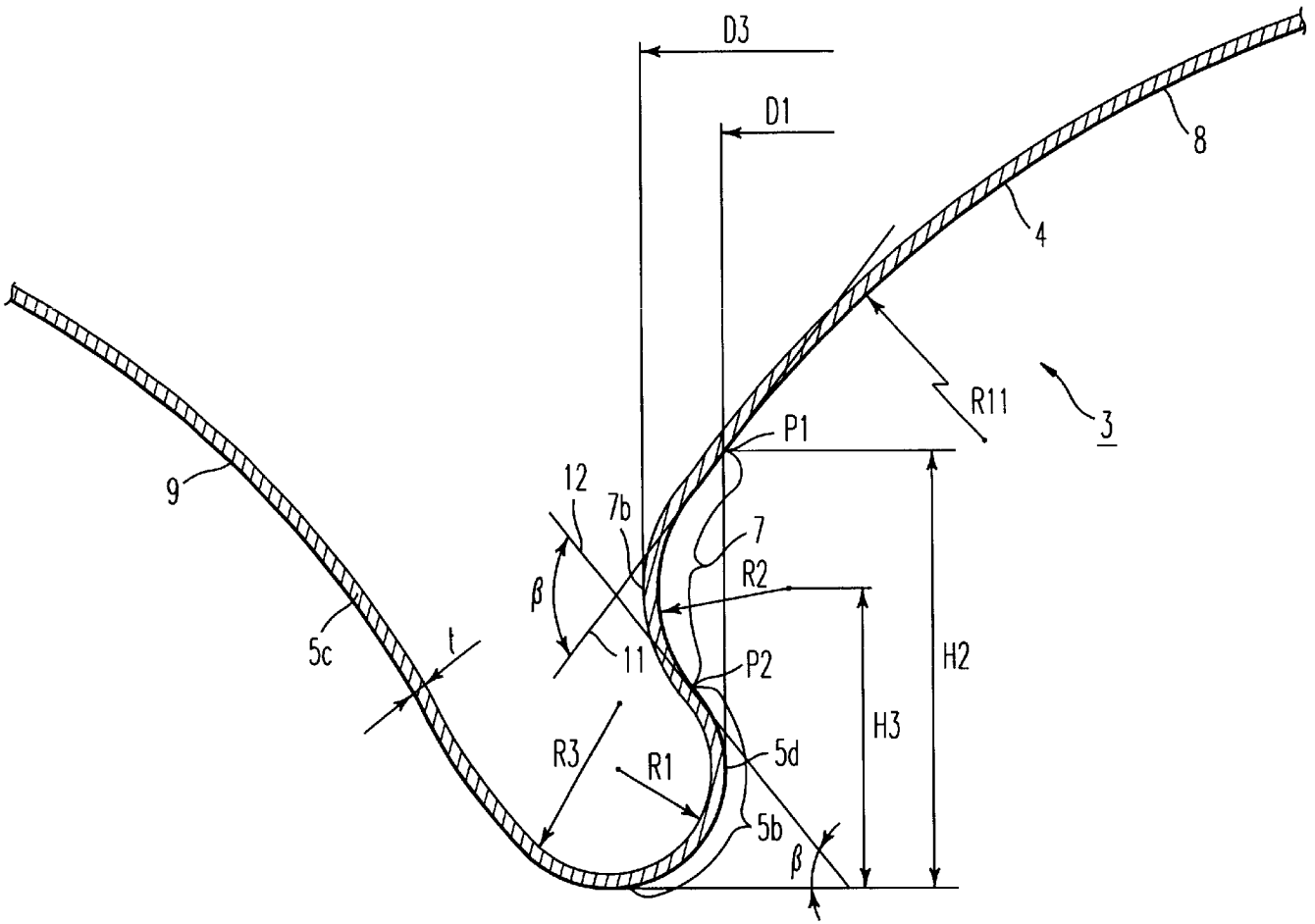
FIG. 8 is an enlarged view explaining the vicinity of the annular projection in FIG. 5 in more detail.

As shown in FIG. 7, each inner recess 7 is formed in an arc shape, when viewed from plan view, and a plurality of the inner recesses 7 are formed so as to be recessed inwardly of the can body 2. Longitudinal ribs 7*a* are formed between the inner recesses 7, and the inner recesses 7 and the longitudinal ribs 7*a* are alternately formed in the circumferential direction. Then, the inner recesses 7 and the longitudinal ribs 7*a* are formed to smoothly join each other, and the inner wall 5*b* is formed in a flower leaf shape, when viewed in the cross section thereof in the circumferential direction. The inner recesses 7 are processed to be within the range of 63%–99% of the entire inner wall 5*b* in the circumferential direction thereof, when the portion, where the inner recesses 7 are formed, is viewed in the cross section thereof in the circumferential direction.

Further, the molded sections 8 are formed at a portion located between the center 4*a* of the dome section 4 and the inside recesses 7 so as to join the inner recesses 7. The number of molded sections 8 are formed to be the same as the number of inner recesses 7 so that the molded sections 8 correspond to the inner recesses 7 and are disposed annularly about the center 4*a* of the dome section 4, as shown in FIG. 7. Inflection points P are formed in the molded sections 8 so that the molded sections 8 are bent from the original shape of the dome section 4 inwardly of the can body 2 and have a diameter D2 (i.e., the annular diameter of the molded sections 8 which are disposed annularly). At the time, the molded sections 8 are formed at positions where $0.65 \leqq D2/D1 \leqq 0.9$ is satisfied with respect to the above dome diameter D1.

Incidentally, the size and angle of the can bottom 3 are important factors in securing a sufficient can strength. This matter will be described in more detail using FIG. 8.

First, a bottom 7*b*, which is the extreme end of each inner recess 7 in a horizontal direction, is formed, and the longest diameter D3 of the dome section is formed at the bottom 7*b*. The diameter D3 must satisfy $1.01 \leqq D3/D1 \leqq 1.15$. Further, the maximum outside diameter of the can 1 (i.e., the diameter of the can body 2) is represented by D (not shown). The diameter D and the longest diameter D3 of the dome section are set to satisfy $0.60 \leqq D3/D \leqq 0.85$. As optimum values, when the diameter D is 66.3 mm, the diameter D1 is set to 45.0 mm and the diameter D3 is set to 47.7 mm, taking the upright standing stability of the can 1, and similar into consideration.

Each inner recess 7 is curved at a predetermined radius of curvature R2. Inflection points P1 are formed at the upper ends of the inner recesses 7 (i.e., at the portions thereof where the radius of curvature is varied). In addition, inflection points P2 are formed at the lower ends of the inner recesses 7 (i.e., at the portions thereof where the radius of curvature is varied). The inner recesses 7 are joined to the portion of the dome section 4, having a radius of curvature which is R1, through the inflection points P1 as boundaries and the inner recesses 7 are joined to the inner wall 5*b* (the radius of curvature of which is R1) through the inflection points P2 as boundaries. Note that the inner wall 5*b* is joined to the portion of the outer wall 5*c* which has a radius of curvature R3 through the nose 5*a* as an inflection point.

An angle $\theta$ is set between a tangential line L1 at the inflection point P1 and a tangential line L2 at the inflection point P2, and the angle $\theta$ is set to satisfy $85° \leqq \theta \leqq 103°$ and more preferably, to satisfy $98° \leqq \theta \leqq 103°$.

Further, the inclination $\beta$ of the tangential line L2 at the inflection point P2 $(90°-\alpha)$ is set within the range of $40° \leqq \beta \leqq 70°$ and its optimum value is 57°.

A sheet thickness t is set within the range of 0.2 mm$\leqq$t$\leqq$0.3 mm and optimally to 0.26 mm, and the radii of curvature R1, R2 and R3 are set within the ranges of $2t \leqq R1 \leqq 7t$, $2t \leqq R2 \leqq 12t$, and $3t \leqq R3 \leqq 10t$, respectively. However, there is a possibility that a film defectively coats the can 1 in the vicinities of the lower limit values of the respective ranges and that a withstanding pressure is insufficient in the vicinities of the upper limit values of the respective ranges. To cope with these problems, when the sheet thickness t is set to 0.26 mm, the optimum values of R1, R2, and R3 are set to 1.0 mm, 1.1 mm, and 1.5 mm, respectively.

The distance from the nose 5*a* to the center 4*a* of the dome section 4 in the direction of the can axis 0 (i.e., the maximum height of the dome section 4) is set to H1 (not shown). The distance from the nose 5*a* to the inflection point P1 in the direction of the can axis 0 is set to H2, and the distance from the nose 5*a* to the center of the radius of curvature R2 in the direction of the can axis 0 is set to H3. These values H1, H2. and H3 are set to establish the relationships, as follow: within the ranges of $0.1 \leqq H3/H1 \leqq 0.4$ and $1.4 \leqq H2/H3 \leqq 2.0$. The optimum values of H1 and H3 are 11.5 mm and 2.9 mm, respectively. The value H2 may be within the above range.

It is desirable to set the respective sizes and angles as described above to satisfy the other requirements such as the upright standing stability, the coating property and similar, while ensuring a sufficient can strength.

As described above, the plurality of inner recesses 7, the cross sections of which are recessed in an arc shape, and the longitudinal ribs 7*a,* which are interposed between the respective inner recesses 7, are alternately disposed in the circumferential direction of the inner wall 5*b* of the annular projection 5 and the cross sectional shape of the inner wall 5*b* in the circumferential direction is formed in the flower leaf.

Accordingly, the rigidity of the inner wall 5*b,* in particular, the rigidity thereof to the stress in the direction of the can axis 0 is increased, and thus no distortion (elongation) is caused to the inner wall 5*b* in the direction of the can axis 0, even if an internal pressure acts thereon. Thus, the annular projection 5 is prevented from deforming downwardly and radially outwardly.

Further, it is preferable that the inner recesses 7 are recessed inwardly of the can body 12 at an angle of 20°–50° with respect to the line L as the tangential line extended from the inner projection 5*d* in the direction of the can axis. If the angle is less than 20°, the desired effect of the reduction of bottom growth cannot be obtained, whereas if the angle exceeds 50°, the distance between the inner wall 5*b* of the annular projection 5 and the outer wall 5*c* thereof is shortened and thus the upright standing stability is lowered and the annular projection 5 is broken, during processing.

Further, it is preferable that the portion where the inner recesses 7 are processed (i.e., the portion where the inner wall 5*b* is pressed with the punch pawls 41) is within the range of 63%–99% of the entire periphery of the inner wall 5*b* in the circumferential direction of the portion of the inner wall 5*b,* where the inside recesses 7 are formed when the portion is viewed in the cross section.

This will be described using FIG. 9.

Figure 9:
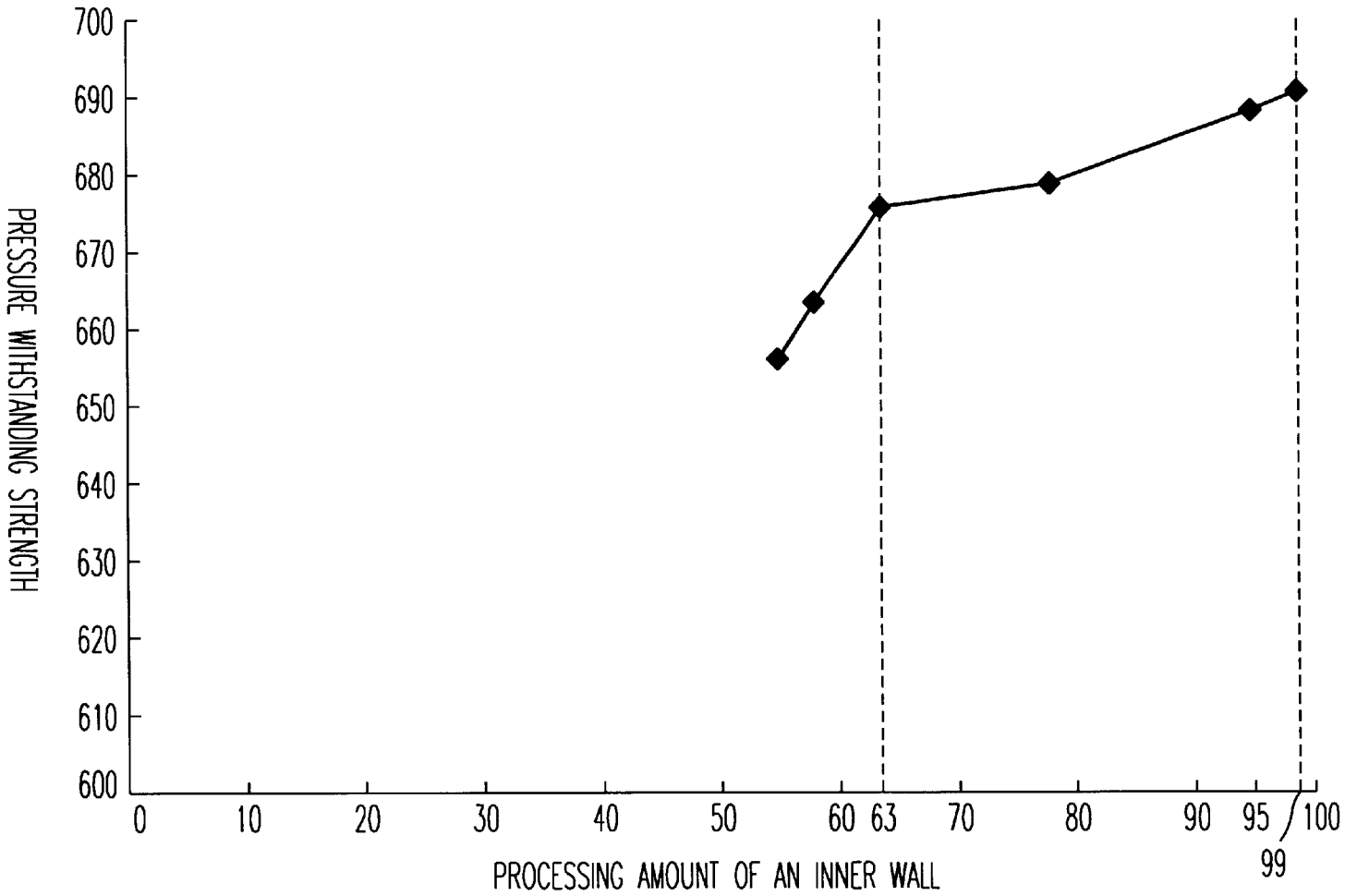
FIG. 9 is a graph explaining the relationship between a pressure withstanding strength and a processing amount of an inner wall.

In the graph shown in FIG. 9, the ordinate represents a pressure withstanding strength as the internal pressure of the can 1, when the can 1 is broken in a falling test, which is performed by changing the internal pressure of the can 1 by packing contents therein. The abscissa represents a processing amount of the inner wall 5*b,* which is the ratio of the range of the inner wall 5*b,* where it is pressed with the punch pawls 41, to the entire range of the inner wall 5*b* in the circumferential direction. As shown in FIG. 9, when the processing amount of the inner wall 5*b* is set to 63% or more, the pressure withstanding strength shows a high value of about 675 kPa or more, whereas when it is set to less than 63%, the inner wall cannot obtain a sufficient rigidity and the desired effect cannot be achieved. Then, the pressure withstanding strength increases as the processing amount increases. In the manufacturing method of the embodiment, since the can bottom 3 is expanded with the plurality of punch pawls 41, the upper limit of the actually possible processing amount of the inner wall 5*b* is 99%. In other words, the longitudinal ribs 7*a* are formed in the range of at least 1%. As a result, the can 1 may obtain a sufficient pressure withstanding strength by setting the processing amount of the inner wall 5*b* to between 63%–99%.

The number of locations where the inner recesses 7 are formed (i.e., the number of locations where the punch pawls are disposed) is preferably 12 to 48. Incidentally, the number is set to sixteen in the above manufacturing apparatus. This is because when the number less than 12, the region of the inner wall 5*b,* where it is pressed with a single punch pawl, is too large to obtain the processing amount of the inner wall, which is necessary to obtain the desired effect. Thus, the inner recesses 7 cannot be stably formed and the can bottom 3 cannot obtain a sufficient strength. In contrast, when the number exceeds 48, the punch pawls 41 cannot be stably formed by slit processing because the number of the punch pawls 41 to be installed is too large.

Next, why the bottom growth of the can 1 can be greatly reduced by the formation of the plurality of molded sections 8 on the can bottom 3 will be described using FIG. 10.

Figure 10:
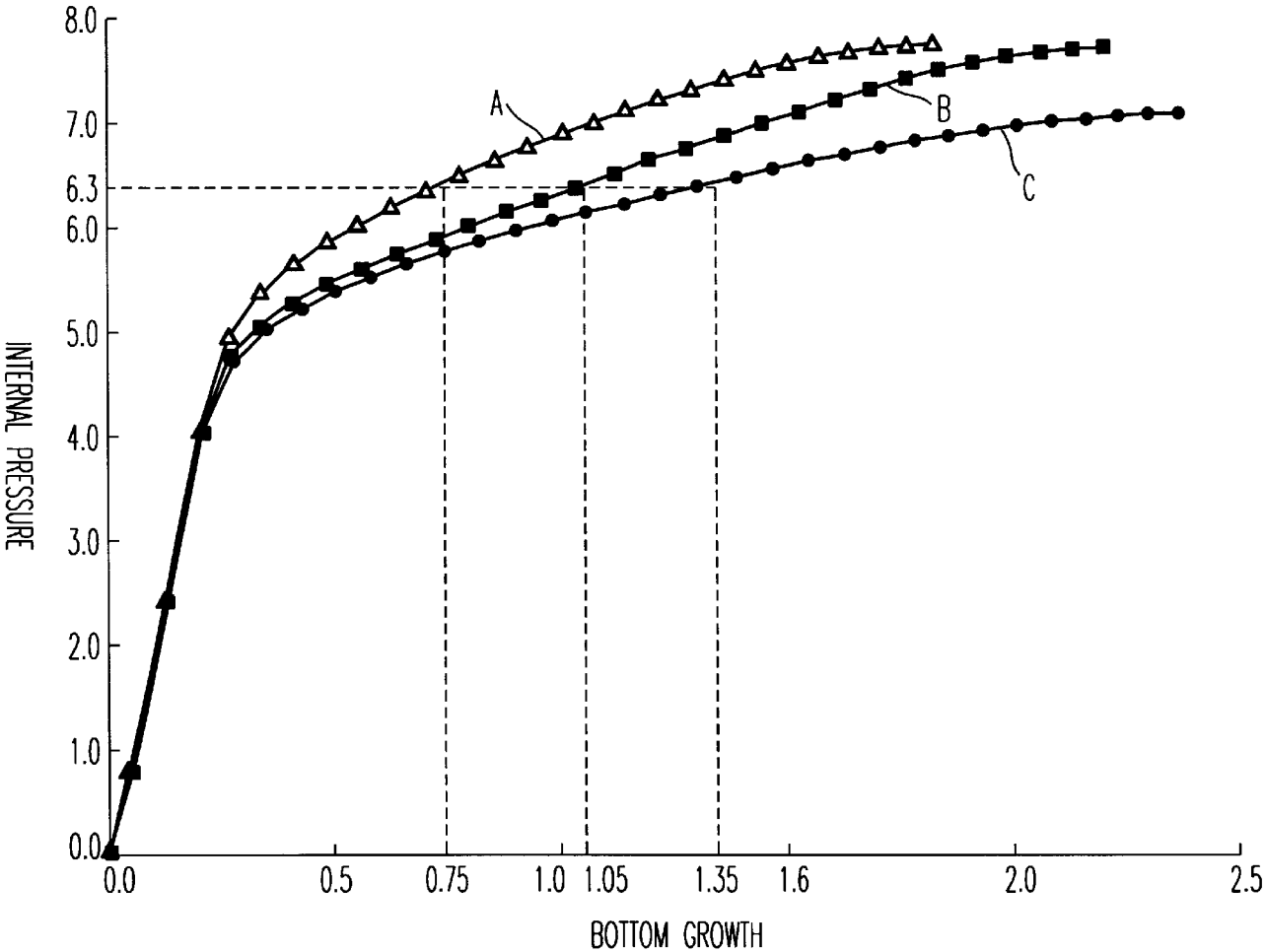
FIG. 10 is a graph explaining the relationship between the internal pressure of a can and bottom growth.

FIG. 10 is a graph showing a result of comparison of bottom growths when the molded sections 8 are formed on the inner wall 5*b* and when they are not formed thereon. The ordinate represents an internal pressure acting on the can 1 and the abscissa represents bottom growth occurring when the internal pressure acts thereon.

Figure 11:
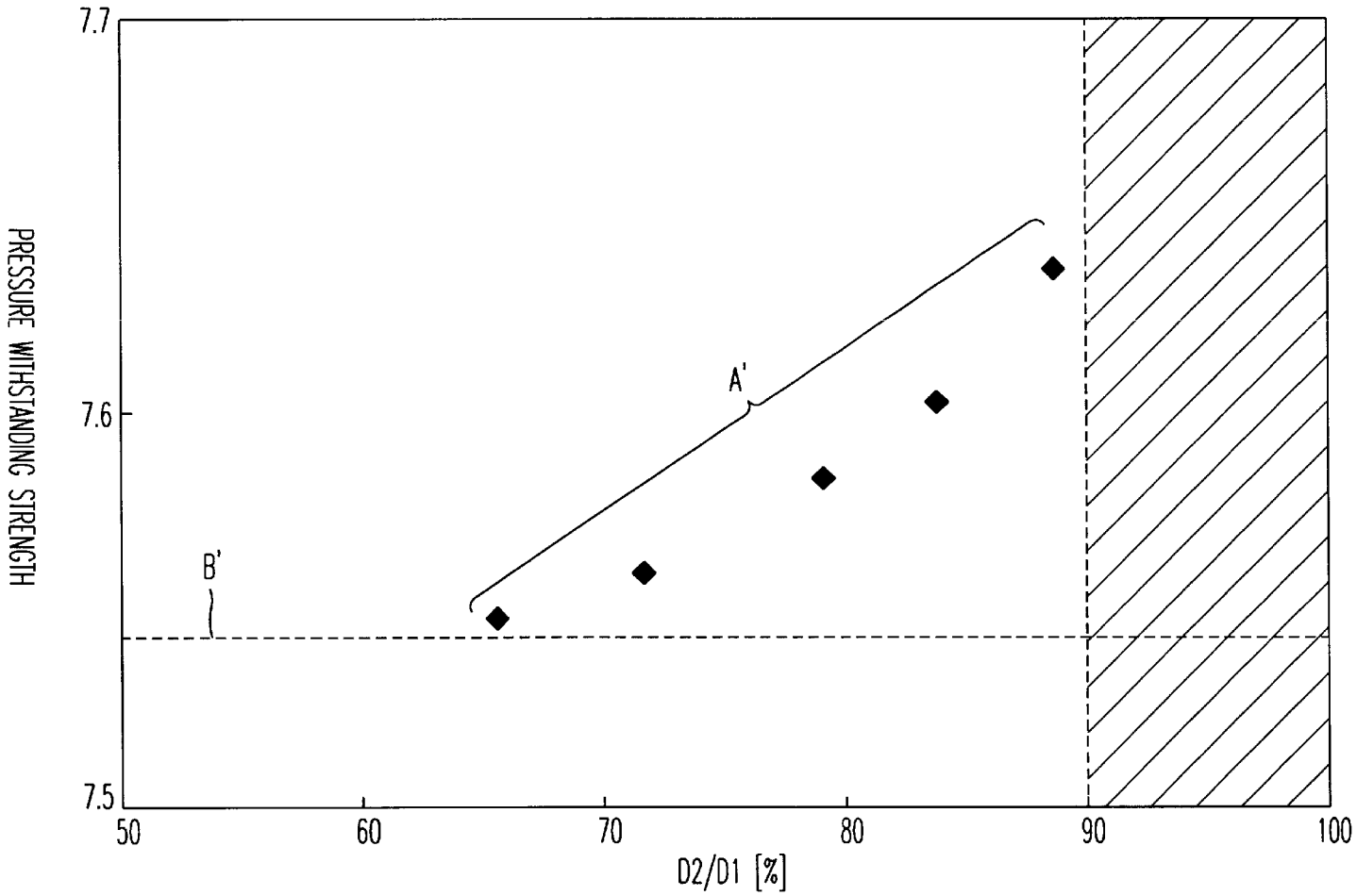
FIG. 11 is a graph explaining the relationship between a pressure withstanding strength and a location where a molded section is formed.

In FIG. 10, a line (sample) A shows a case in which the inner recesses 7 and the longitudinal ribs 7*a* are formed on the inner wall 5*b* in a flower leaf shape and the molded sections 8 are formed by pressing the periphery of the dome section 4 with the extreme end corners 41*g* of the punch pawls 41. A line (sample) B shows a case in which the inner recesses 7 are formed by pressing only the inner wall 5*b* with the pawls 41*d* of the punch pawls 41. The distance of the inclining surfaces 41*e* is short when the dome section 4 is not pressed (without forming the molded sections 8) as shown in FIG. 11. A line (sample) C shows a case in which neither the inner recesses 7 nor the molded sections 8 are formed.

When the internal pressure acting on the can 1 is within the range of about 0–4 $Kg/cm^2$, there is no large difference between the bottom growths occurring in the respective samples A, B, and C. However, when the internal pressure exceeds 4 $Kg/cm^2$, the bottom growths in samples A and B, in which the can bottoms 3 are processed, are greatly improved. In particular, the bottom growth in the sample A, in which the molded sections 8 are formed, is greatly reduced.

When the internal pressure to be acted on is, for example, 6.3 $Kg/cm^2$, the bottom growth of the sample C, which is not subjected to processing, is about 1.35 mm, whereas the bottom growth of the sample B is about 1.05 mm and that of the sample A is about 0.75 mm.

As described above, since the plurality of inner recesses 7 and longitudinal ribs 7*a* are disposed in the circumferential direction of the inner wall 5*b* of the annular projection 5 so that the cross sectional shape of the inner wall 5*b* in the circumferential direction is formed in the shape of a flower leaf, the rigidity of the inner wall 5*b,* in particular, the rigidity thereof to the stress in the direction of the can axis 0, is increased. Thus, bottom growth, which is the distortion (elongation) of the inner wall 5*b* in the direction of the can axis 0, does not occur, even if an internal pressure acts thereon, whereby the annular projection 5 is prevented from deforming downwardly and radially outwardly. As a result, even if the wall thickness of the can 1 is reduced, it has a sufficient strength.

Figure 13:
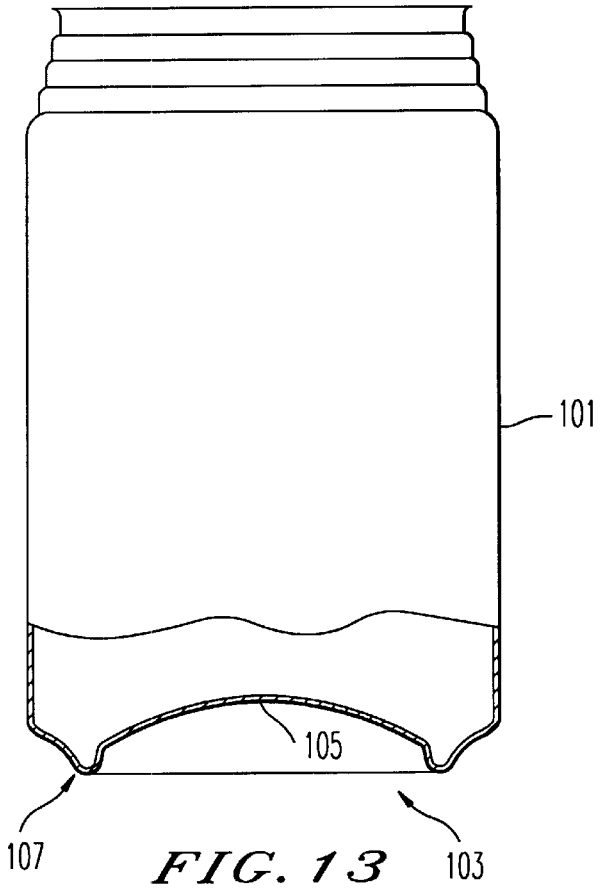
FIG. 13 PRIOR ART
FIG. 13 is a view explaining a conventional can.

Further, since the plurality of molded sections 81, which are recessed inwardly of the can body 2, are formed on the portion between the center 4*a* of the dome section 4, which is joined the inner wall 5*b* of the annular projection 5, and the inner wall 5*b* and the molded sections 8 are disposed annularly about the center 4*a,* the strength of the processed portion is increased. As a result, the bottom growth occurring in the thus formed can 1 is reduced up to about half the bottom growth occurring when the molded sections 8 are not formed under the condition that the same internal pressure is acted upon as shown in FIG. 13.

At the time, the pressure withstanding strength of the sample B is 7.02 $Kg/cm^2$, whereas the pressure withstanding strength of the sample A is 6.85 Kg $/cm^2$. In other words, a result can be obtained, wherein the sample B, in which the molded sections 8 are not formed, has a larger pressure withstanding strength.

Next, an experiment performed to examine locations where the molded sections 13 are formed will be described. FIG. 11 is a view showing the relationship between a location where a molded section 8 is formed and a pressure withstanding strength.

In FIG. 11, the abscissa represents D2/D1, which is a ratio of the diameter D2 of a molded section 8 to the diameter D1 of a dome, and the ordinate represents a pressure withstanding strength.

Further, a line B' shows the pressure withstanding strength of a sample B' in which the molded sections 8 are not formed, and dots A' shows the pressure withstanding strengths of a sample A' in which both inner recesses 7 and molded sections 8 are formed.

Figure 14:
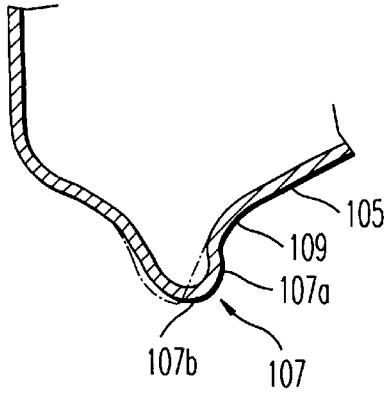
FIG. 14 PRIOR ART
FIG. 14 is a view explaining bottom growth.

When D2/D1 is smaller than 0.65 (i.e, when the molded sections 8 are formed in the vicinity of the center of the dome section 4), there is no remarkable difference in the pressure withstanding strength between the samples A' and B'. However, when D2/D1 exceeds 0.65 (i.e., when the molded sections 8 are formed on the side of the annular projection 5), the pressure withstanding strength is gradually increased, as shown in FIG. 14. Further, the pressure withstanding strength is increased as the locations, where the molded sections 8 are formed, are positioned more outwardly of the dome section 4 in the radial direction. However, when D2/D1 is too large, as in a region M, the dome section 4 is broken when it is processed and cannot be further processed.

As described above, the pressure withstanding strength is increased by forming the molded sections 8 so that D2/D1 is set to 0.65–0.9.

Further, it is preferable that each inner recess 7 is formed such that the angle θ between the tangential line at the inflection point P2 and the tangential line at the inflection point P2 satisfies $85° \leqq \theta \leqq 103°$, and it is more preferable that the angle θ satisfies $90° \leqq \theta \leqq 103°$ within the above range.

Figure 12:
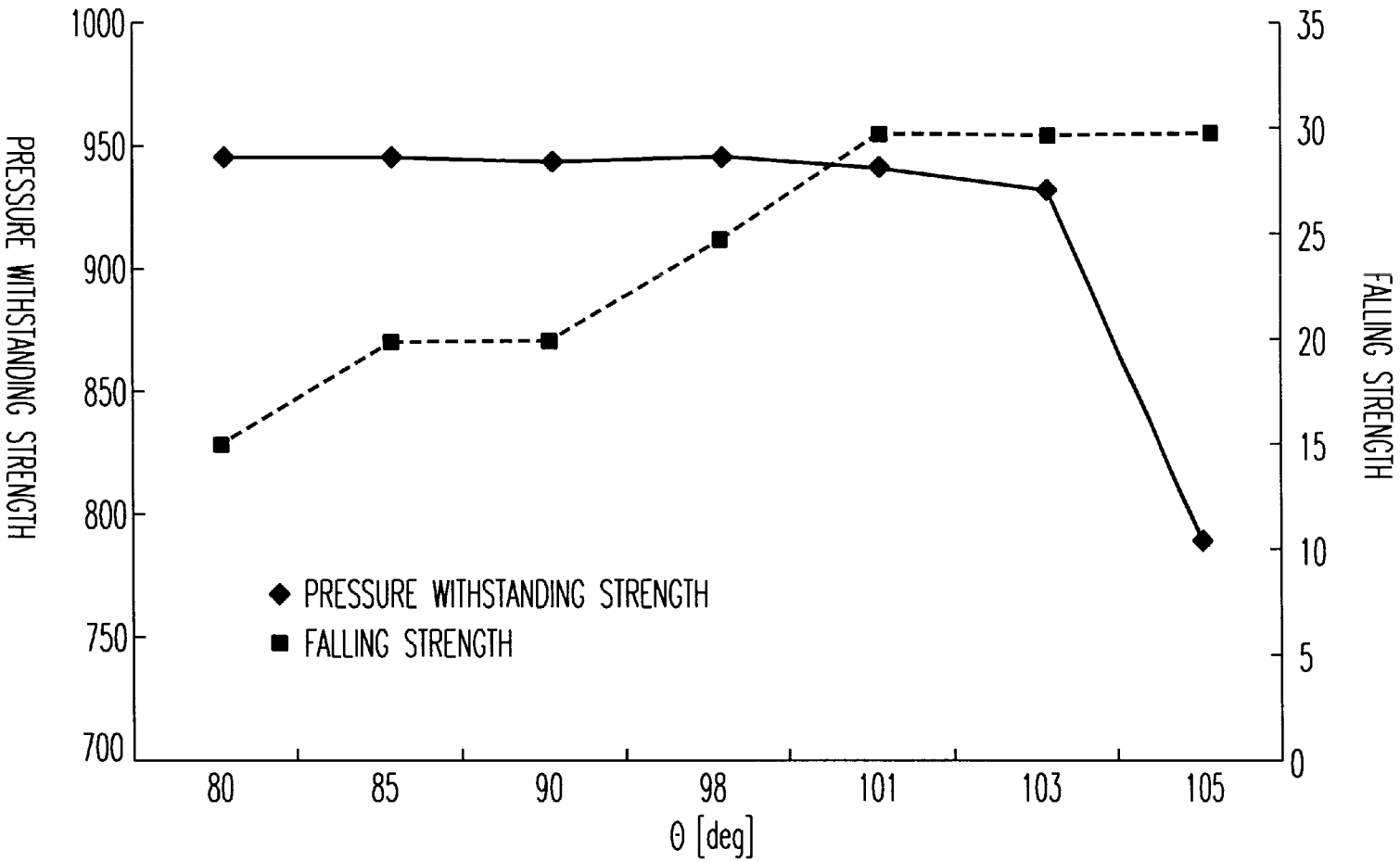
FIG. 12 is a graph explaining the relationship between a pressure withstanding strength, a falling strength and an angle θ.

This will be described using the table in FIG. 15 and the graph in FIG. 12. As shown in the table in FIG. 15 and the graph of FIG. 12, when the angle θ is less than 85° (i.e., when the angle is, for example, 80°), the falling strength is small, and no problem has particularly arisen with respect to the pressure withstanding strength, an excellent result as to can strength cannot be obtained. Similarly, when the angle θ is greater than 103° (i.e, when it is, for example, 105°), a pressure withstanding strength has become extremely low, while a falling strength remains at a high value. Thus, an excellent result as to can strength is also unobtainable in this case. As apparent from FIG. 12, it is when the angle θ is set to the range of $85° \leqq \theta \leqq 103°$ that a relatively excellent can strength, in which a pressure withstanding strength is 930–950 kPa and a falling strength is 20 cm or more, can be obtained.

Of the above range of the angle θ, when it is set to satisfy $98° \leqq \theta \geqq 103°$, a very excellent can strength, in which a pressure withstanding strength is 930–950 kPa and a falling strength is 25–30 cm, can be obtained.

Note that, the falling strength is defined as a height at which the dome section of an iron sheet is completely reversed, when a can, in which an internal pressure is set to 4 $kg/cm^2$, is fallen from a position, the height of which is varied each 5 cm, onto the iron sheet.

Further, the pressure withstanding strength is measured by a method of feeding a pressurized air into a can. That is, when a pressurized air is fed into a can, the internal pressure of the can is increased and a dome section is instantly deformed so as to reverse outwardly at a certain timing and the internal pressure in the can is abruptly lowered simultaneously with the deformation. The value of the internal pressure in the can just before it is lowered (i.e., the maximum value of the internal pressure) is defined as the pressure withstanding strength.

In the can according to the embodiment, since the range of the angle θ is set to satisfy $85° \leqq \theta \leqq 103$, and more preferably $98° \leqq \theta \leqq 103°$, the pressure withstanding strength and the falling strength of the can are improved, whereby a sufficient can strength can be secured.

Further, since the range of D3/D1 is set to satisfy $1.01 \leqq$ D3/D1 $\leqq 1.15$, the can strength can be increased.

Further, since the range in which the inner recesses 7 are formed is set to 63%–99% of the entire inner wall 5*b* in the circumferential direction, the annular projection 5 can obtain a sufficient rigidity.

Furthermore, since the molded sections 8, which are recessed inwardly of the can body 2, are formed in number to be as many as the inner recesses 7, and are disposed annularly about the center 4*a* of the dome section 4, the strength of the can bottom 3 can be increased and the effect of bottom growth of the thus formed can 1 can be reduced.

As described above, according to the present invention, a can, a can manufacturing apparatus and a can manufacturing method are provided. The apparatus and method are for manufacturing a can in which a sufficient can strength can be secured without deforming a can bottom, even if the thickness of the can bottom is reduced, and the occurrence of bottom growth is suppressed.

What is claimed is:

1. A can manufacturing apparatus for forming a can having a can body including a dome section and an annular projection, wherein said dome section is formed on a bottom of said can and is recessed inwardly, wherein said annular projection is formed around the peripheral edge of the dome section and projects outwardly in a direction of an central longitudinal axis of said can, and wherein a plurality of inner recesses are formed on an inner peripheral wall of said annular projection in a circumferential direction and are formed inwardly, said apparatus comprising:

an apparatus main body;

a can body support means disposed on said apparatus main body for supporting said can body;

a can bottom processing means disposed on said apparatus main body so as to move in said direction of said central longitudinal axis of said can relative to said bottom of said can, wherein said can processing means has a plurality of punch pawls disposed in the circumferential direction, each punch pawl of said plurality of punch pawls having an extreme end section, which can move in a radial direction and which projects toward said can body support means;

a punch pawl moving means for moving extreme ends of said extreme end section outwardly in a radial direction; and a dome support means for supporting said dome section, wherein said dome support means abuts said dome section from an inside of each punch pawl of said plurality of punch pawls in said radial direction thereof.

2. The can manufacturing apparatus according to according to claim 1, wherein said can and said can body support means are movable in said direction of said central longitudinal axis of said can with respect to said apparatus main body, and wherein said can bottom forming means is unmovable in said direction of said central longitudinal axis of said can with respect to said apparatus main body.

3. The can manufacturing apparatus according to claim 1 or 2, further comprising an outer peripheral wall forming means for forming an outer peripheral wall of said annular projection.

4. A can manufacturing method for manufacturing a can having a can body including a dome section and an annular projection, wherein said dome section is formed on a bottom of said can and is recessed inwardly of said can body, and wherein said annular projection is formed around a peripheral edge of said dome section so as to project outwardly in a direction of a central longitudinal axis of said can, said method comprising the steps of:

supporting said can body;

supporting said dome section by abutting a dome support member thereagainst;

forming a plurality of inner recesses on an inner peripheral wall of said annular projection in a circumferential direction, wherein each inner recess of said plurality of inner recesses is recessed inwardly with respect to said can body; and moving extreme ends of each punch pawl of a plurality of punch pawls, wherein each punch pawl of said plurality of punch pawls are disposed in said circumferential direction and are movable in a radial direction from a region located inwardly of a nose section of said annular projection at an extreme end thereof in said radial direction to an external region in said radial direction.

* * * * *